US005345769A

United States Patent [19]

Liepert et al.

[11] Patent Number: 5,345,769

[45] Date of Patent: Sep. 13, 1994

[54] CRYOGENIC REFRIGERATION APPARATUS

[75] Inventors: Anthony G. Liepert, Boston; James A. Crunkleton, Auburndale; Gregory R. Gallagher, West Newton; Joseph L. Smith, Jr., Concord, all of Mass.; Frederick J. Cogswell, Glastonbury, Conn.

[73] Assignee: Boreas, Inc., Burlington, Mass.

[21] Appl. No.: 975,279

[22] Filed: Nov. 12, 1992

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS 4,700,545 10/1987 Ishibashi et al. ..... 62/6
4,845,953 7/1989 Misawa et al. ..... 62/6
4,862,694 9/1989 Crunkleton et al. ..... 62/6
5,099,650 3/1992 Crunkleton ..... 62/6

*Primary Examiner*—Ronald C. Capossela
*Attorney, Agent, or Firm*—Robert F. O'Connell

[57] ABSTRACT

A system for providing a cold environment which has a number of cooling stages with variable displacement volumes into which input fluid from a compressor flows in an input channel to and from the displacement volumes and output fluid flows in an output channel to the compressor. Volume changers vary the volumes of the displacement volumes and input fluid flowing to a first set of displacement volumes is pre-cooled by regenerative heat exchange and counterflow heat exchange and input fluid flowing to the final displacement volume is pre-cooled primarily by counterflow heat exchange. The volume changer at at least one of the stages is thermally decoupled from the input and output channels.

38 Claims, 9 Drawing Sheets

CRYOGENIC REFRIGERATION APPARATUS

INTRODUCTION

This invention relates generally to cryogenic refrigerant apparatus for providing a fluid at extremely low temperatures and, more particularly, to such an apparatus which uses a technique and mechanical configuration for permitting such low temperatures to be reached in a reliable and efficient manner at a reasonable cost in an apparatus the size of which can be relatively small and compact.

BACKGROUND OF THE INVENTION

A new process of refrigeration has recently been developed for achieving efficient refrigeration below 10 Kelvin, particularly at liquid-helium temperatures. A basic description of a system using such process and describing the operating cycle thereof is set forth in U.S. Pat. No. 5,099,650 issued on Mar. 31, 1992 to J. A. Crunkleton. Additional background information concerning such technique is also described in U.S. Pat. No. 4,862,694 issued on Sep. 3, 1989 to J. A. Crunkleton and J. L. Smith, Jr. The more recently issued patent discloses a method for attaining refrigeration at liquid-helium temperatures using a simple and compact multi-stage system configuration. It is helpful in understanding the invention here to review in some detail below the operation of such prior used process.

In a system described in U.S. Pat. No. 5,099,650 which uses two or more stages, in the warmer stages, i.e., those generally at about 20 K. and above, heat transfer occurs between the fluid and the structural material (referred to as a regenerative heat exchange operation), as well as between fluid flowing in separate input and output cooling channels (referred to as a counterflow operation). Fluid flowing in the output channel originates only from the colder stages, i.e., those generally below 20 K., having a connection (e.g., a valve) between the input and output channels. In the colder stages, where obtaining high heat-exchange effectiveness with conventional regenerative structural materials is difficult, heat transfer occurs primarily by counterflow heat exchange. Thus, the technique achieves high heat-exchange effectiveness over the entire temperature range from room temperature down to liquid-helium temperatures by using counterflow heat exchange almost exclusively in the colder stages and by using a combination of both counterflow and regenerative heat exchange in the upper stages, where the inherent mechanical simplicity of a regenerative heat exchange operation may be exploited with high heat-exchange effectiveness.

One embodiment of the technique discussed therein incorporates heat exchangers and piston-cylinder expanders in an integrated two-stage configuration. In that arrangement, the heat exchanger in the warmer stage undergoes both counterflow and regenerative heat-exchange processes, while the colder stage undergoes primarily a counterflow heat exchange process. One exemplary cycle of operation for a two-stage configuration can be described as follows.

Displacement volumes, alternatively referred to as expansion volumes, at each stage of a two-stage configuration are periodically recompressed to a high pressure by reducing the displacement volume in each stage to substantially zero, or near zero, volume. By opening an inlet valve at the warm (e.g., at or near room temperature) end of an input channel, and by increasing the displacement volumes, further fluid under pressure, as supplied from an external compressor, is caused to flow into the input channel at a first relatively warm temperature (e.g., at or near room temperature). The fluid that has been introduced into the input channel is pre-cooled by regenerative and counterflow cooling as it flows through the input channel to the first stage expansion volume at which region it has been pre-cooled to a second temperature below the first temperature. A further portion of the incoming fluid and a residual fluid portion from the previous cycle continue to flow past the first expansion volume in the input channel to the second stage expansion volume at the cold end of the channel. These latter fluid portions are further pre-cooled primarily by counterflow cooling, as well as by some, though much less, regenerative cooling, as they flow in the input channel to the second expansion volume at a third temperature below the second temperature.

The expansion volume at the first stage, i.e., the "warm" stage, is increased, i.e., expanded, so that the compressed fluid therein is expanded from the high pressure at which it had been pressurized to a substantially lower pressure so as to reduce the temperature of the fluid in or near the "warm" displacement volume to a fourth temperature which is substantially lower than the second temperature, but generally higher than the third temperature.

The displacement volume at the second stage, i.e., the "cold" stage, is increased simultaneously with that of the first stage to form an expanded volume at the second stage so that the compressed fluid therein is expanded from the high pressure at which it had been pressurized to a substantially lower pressure so as to reduce the temperature of the fluid in or near the "cold" displacement volume to a fifth temperature which is lower than the third temperature.

At the end of the expansion stroke (at which time maximum expansion volumes exist), the warm exhaust valve and the cold exhaust valve open, which results in blow down if a pressure difference exists across the valves before opening. Although both exhaust valves are opened at some time during the blow down and the constant-pressure exhaust periods, the valves are not necessarily opened or closed at the same time.

The displacement volume at the warm stage is decreased and the low pressure expanded fluid therein is caused to flow back into the input channel from the first stage displacement volume, toward the inlet end of the input channel and thence outwardly therefrom through a "warm" output valve thereat, a small portion thereof alternatively flowing to the cold stage.

Further, the very-low-temperature, low-pressure, expanded fluid which is used to produce the cold environment at the second stage is caused to flow from the "cold" displacement volume, as a result of the decrease in such displacement volume, into an output channel via a "cold" valve and a surge volume thereat, a small portion thereof alternatively flowing through the input channel to the warm stage. The very-low-temperature expanded fluid, which may be two phase, for example, is used to produce a cold environment for a heat load applied thereto, heat being transferred from the environmental heat load to the expanded fluid thereby boiling the two-phase fluid and/or warming the gaseous fluid and cooling the environment. A further heat load may be applied to the warm stage for cooling thereof also.

The lower-pressure fluid, which is caused to flow over a first time duration from the "warm" first-stage displacement volume at the fourth temperature towards the inlet end of the input channel and through the warm exhaust valve thereat, is in intimate contact with the warmer surfaces of the piston and cylinder and exchanges heat with these warmer surfaces thereby warming the fluid exiting from the warm exhaust valve and cooling the piston and cylinder in preparation for the following cycle. This type of heat exchange is commonly referred to as regenerative heat exchange. Simultaneously with such operation, but over a second longer time duration, the expanded low-temperature, low-pressure fluid from the "cold" displacement volume is caused to flow in the output channel at a substantially constant flow rate and at a substantially constant pressure to a fluid exhaust exit at the warm output end of the output channel. During operation, direct counterflow heat exchange is provided between the input and output channels to produce a pre-cooling of incoming fluid in the input channel and a warming of the fluid in the outlet channel to a temperature at or near the first temperature, less allowance of a heat exchange temperature difference prior to its exit therefrom. The warm exiting fluid from both the input and output channels is compressed, as by being supplied to an external compressor system, so as to supply fluid under pressure from the compressor system for the next operating cycle.

Residual portions of the expanded fluid which resulted from the expanded operation of a previous cycle remain in the displacement volumes and in the input channel. Such remaining fluid may undergo recompression if the warm and cold exhaust valves are closed before minimum displacement volumes are reached. The device is now ready to execute the next expansion cycle. The compressed fluid from the compressor system is next supplied via the input channel to the first and second stage displacement volumes. The fluid flowing to the first stage displacement volume is pre-cooled by regenerative heat exchange with the piston and cylinder structures, and by counterflow cooling by the cold fluid flowing in the output channel. The fluid flowing to the second stage displacement volume is primarily precooled by counterflow heat exchange with the cold fluid flowing in the output channel, although there may be some, but much less, pre-cooling due to regenerative cooling.

The overall compression, intake, expansion, and exhaust process is then repeated, the fluid in the displacement volumes and in the input channel being again periodically compressed and the expansion thereof occurring as before.

The size of the heat load (i.e., including both an applied heat load and/or parasitic heat leaks) at either stage has a relatively large impact on the type of heat exchange operation at the warm stage. If the heat load at the cold stage is much smaller than that at the warm stage, regenerative heat exchange dominates at the warm stage. If the heat load at the cold stage is relatively larger than that at the warm stage, counterflow cooling may account for most of the heat exchange at the warm stage. This is because a relatively larger heat load on the cold stage requires more mass flow to the cold stage. This larger mass flow rate returns to the compressor primarily through the output passage, which results in more counterflow heat exchange in the warm stage.

The power requirement of the refrigerant apparatus can be decreased by increasing the number of precooling stages. For example, two precooling stages, both operating above 20 K., significantly reduce the power requirement. In this example, both precooling stages operating above 20 K. use a combination of both counterflow and regenerative heat exchange.

Preferred configurations of this refrigeration method prescribe annular passages between concentric tubes to be the input and output channels. The input channel is formed by the gap between the piston and cylinder and the output channel is formed by the gap between the cylinder and an outer shell that surrounds the cylinder. If a hollow piston is used, the volume inside the piston is at vacuum to reduce the heat leak. In this arrangement, gap nonuniformities can lead to flow maldistributions in the channels which result in reduced heat exchanger performance. For example, if the piston or cylinder is not perfectly straight and round, or if the piston is not perfectly centered inside the cylinder by some centering means, then the piston-to-cylinder gap is not constant along the circumference at all locations along the length, which results in flow maldistribution. A spiral passage is constructed between the cylinder and outer shell to direct the output-channel flow around the cylinder to reduce the effect of flow maldistribution in the piston-to-cylinder gap. An object of the present invention is to further reduce or substantially eliminate flow maldistributions that are present in the previous systems.

Also in this concentric tube arrangement, the use of the earlier described annular gaps, where the input flow travels axially between the piston and cylinder or where the output flow spirals between the cylinder and outer shell, allows transitions between laminar and turbulent flow conditions over a wide range of temperatures during various parts of the cycle. Heat exchanger performance varies considerably depending on whether the flow is laminar or turbulent, which makes design of the heat exchangers difficult. Another object of the present invention then is to provide a heat exchanger configuration which causes a continuous mixing of the flow in the heat exchangers as the flow proceeds along its length, so the flow is never fully developed into a laminar or turbulent regime but rather is continually mixed.

Different types of drive mechanisms to reciprocate the piston are presented in the aforesaid Crunkleton patent for specific cryocooler embodiments. Two drive mechanisms disclosed therein are described again here for illustrative purposes.

One type of drive mechanism in which no energy is stored uses a pressure-balanced piston, meaning that, in the ideal case, the pressure is equal on all piston surfaces so that no net force is placed on the piston. In an actual device, the pressure is approximately equal at each cross section along the axis of the piston; however, due to pressure drops in the precooling heat exchanger which cause an axial end-to-end pressure difference, a net axial force results on the piston. Because of the phasing of this pressure difference during pressurization and depressurization from the warm end, the resulting axial force can be used to reciprocate the piston. Subtracted from this axial force is the drag of any piston seals as well as other frictional forces resulting from piston motion. Another common pressure-balanced-piston drive mechanism is reciprocated using a stepper motor in combination with a scotch-yoke mechanism. Either configuration would be well known to those in the art.

Another type of drive mechanism, in which energy is stored for use later in the cycle, uses a piston that is not pressure balanced. The resulting force and piston displacement yield an external work transfer from the cold working volume to the room-temperature end. This work can be temporarily stored and then later used for recompression and to overcome any friction such as due to sliding bearings and seals. A typical mechanical configuration to achieve this operation employs a flywheel for energy storage, which would be well known to those in the art.

While the system described in the aforesaid Crunkleton patent provides refrigeration, no technique is disclosed therein to customize each stage of refrigeration to improve performance and to provide high reliability. The present invention consists of several improvements that are intended to increase performance and reliability of components operating over the entire range of temperatures from room temperature down to liquid-helium temperatures. In particular, various improvements have been made to the precooling heat exchangers, the load heat exchangers, mechanisms to control flow in the precooling heat exchangers, mechanisms to control flow to and from the cold head.

SUMMARY OF THE INVENTION

This invention provides a high-performance, refrigerant apparatus which is relatively inexpensive to manufacture, is capable of long life, and has high reliability, while generally using the process of refrigeration disclosed in the aforesaid U.S. Pat. No. 5,099,650.

In particular, unique designs for precooling heat exchangers and expansion pistons are utilized, which designs consider the wide variations in thermodynamic loss mechanisms, such as axial conduction and shuttle heat leak mechanisms, from room temperature down to liquid-helium temperatures. A specific easy-to-manufacture, solid, stainless steel piston is described which operates below 20 K., where conduction heat leak is minuscule. Moreover, a unique heat exchanger is utilized which continuously mixes the flow to prevent the frequent transitions between fully developed laminar and turbulent flow conditions which can occur during a single cycle. The heat exchanger configurations utilized in the invention eliminate the deleterious effects of piston motion on heat exchanger performance. Specifically, flow maldistribution in the input channel due to an eccentric piston is eliminated. Also, the interdependence of heat exchanger performance and an important loss mechanism known as "shuttle heat leak" is eliminated.

Additional aspects of the invention are described which give the designer effective control over mass flow in a multistage refrigeration apparatus, which control is essential to achieve efficient performance. One example of a design to control mass flow is the use of a separate valve to provide intermittent mass flow in the constant-low-pressure output channel of the heat exchanger. A second example employs separate pistons to displace the expansion volumes to control mass flow between the volumes.

Further modifications include an improved structure for providing more effective heat transfer capabilities for cooling a load.

DESCRIPTION OF THE INVENTION

The invention can be described in more detail with the help of the drawings wherein FIG. 1 shows a diagrammatic view of one embodiment of a refrigeration system in accordance with the invention;

Figure 1:
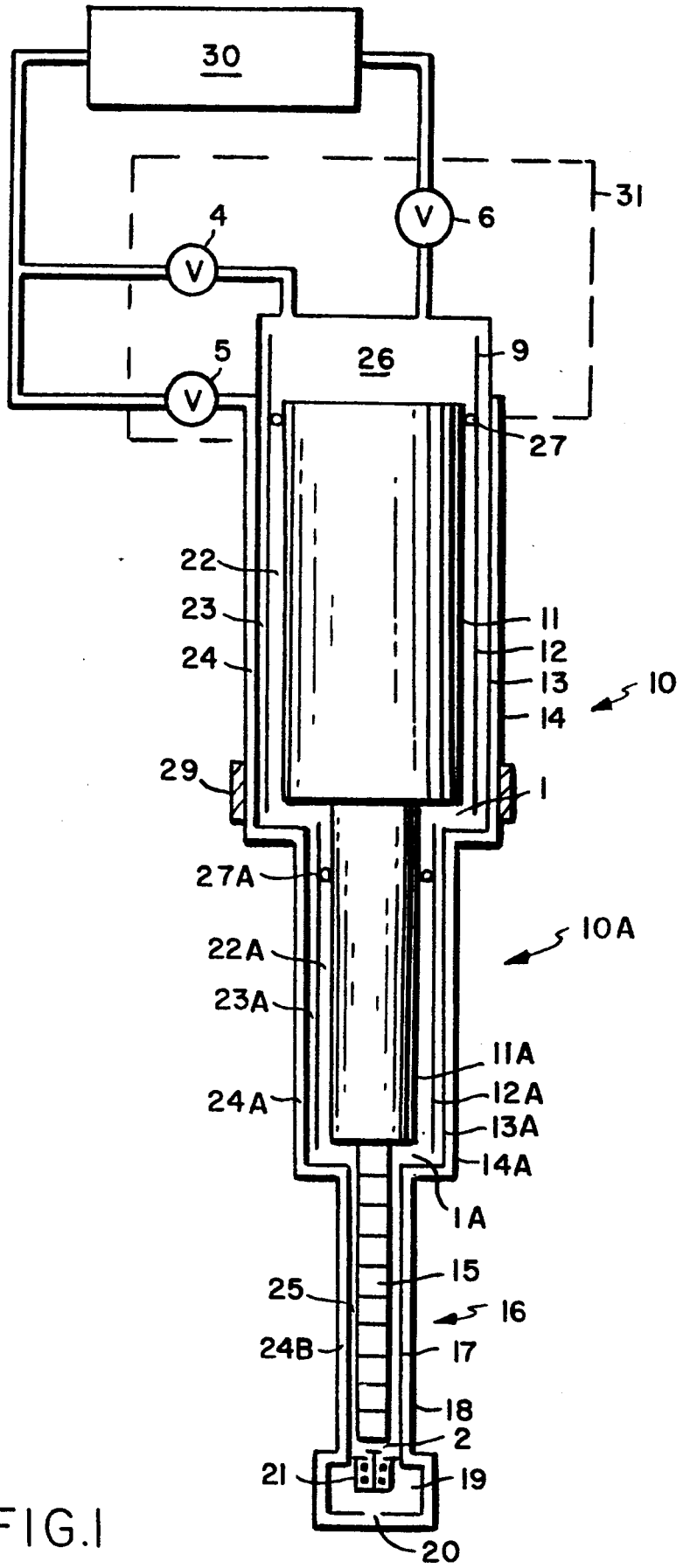

FIG. 1 illustrates a configuration of the invention which is useful in identifying the primary components of a refrigeration system. This system is a three-stage refrigerator with expansion volumes 1, 1A and 2 and precooling heat exchanger stages 10, 10A and 16. A compressor 30 supplies high-pressure gas, typically at room temperature, to an input channel 23 through inlet valve 6 and accepts return gas at low pressure from exhaust valves 4 and 5.

Cold fluid enters the cold surge volume 19 at the cold end of lower stage 16 through exhaust valve 21, the cold fluid passing through a load heat exchanger 20 into an output channel 24B. A heat load from the environment is supplied to the load heat exchanger 29 which isothermalizes a section of the first precooling heat exchanger stage 10. A drive mechanism (not illustrated for purposes of simplicity), reciprocates a pressure-balanced piston system, which comprises pistons 11, 11A and 15, and balance volume 26 at the input end. A heat exchanger 9 connects balance volume 26 with input channel 23 of precooling heat exchanger stage 10. Fluid passing through heat exchanger 9 exchanges heat with the cylinder housing which operates near room temperature. As balance volume 26 is pressurized during the intake process, the helium temperature here rises due to the heat of compression. Heat exchanger 9 allows this heat to be transferred to the coldhead housing 31 depicted by dashed lines in FIG. 1 (and FIG. 2), which housing encloses a portion of the system above the first stage including valves 4, 5 and 6 as shown. The housing is at room temperature and a portion of the input channel is in heat exchange relationship there-with, thereby lowering the inlet temperature to the input channel 23. Insulation for the components operating below room temperature is typically provided by a vacuum in combination with layers of superinsulation, such as aluminized mylar, as would be well known to those in the art.

Heat exchanger stage 10 and expansion volume 1 comprise the warmest stage of the refrigeration apparatus, referred to as the first stage. Heat exchanger stage 10A and expansion volume 1A comprise the second stage, and heat exchanger stage 16 and expansion volume 2 comprise the third stage. Input channel 23 is formed between cylinder tube 12 and heat exchanger tube 13. Input channel 23A consists of cylinder tube 12A and heat exchanger tube 13A. Input channel 25 is formed between segmented piston 15 and cylinder tube 17. Output channel 24 is formed between heat exchanger tube 13 and outer shell tube 14. Output channel 24A is formed between heat exchanger tube 13A and outer shell tube 14A. Output channel 24B is formed between cylinder tube 17 and outer shell tube 18. Fluid flow in the first and second stage piston-to-cylinder gaps 22 and 22A, formed between piston tubes 11 and 11A and cylinder tubes 12 and 12A, respectively, is limited by seals 27 and 27A, respectively. A vacuum space exists inside hollow piston portions 11 and 11A.

Representative ranges of operating temperatures for each expansion volume are about 30 K. to 100 K. for the first stage, about 15 K. to 40 K. for the second stage, and liquid-helium temperatures to 10 K. for the third stage. Specific operating temperatures for each stage depend upon such parameters as the expansion volume bore and stroke, the precooling heat exchanger surface area, and the amount of heat load supplied by the environment or by parasitic heat leaks, along with various valve timings and operating pressures. Specific examples of average operating temperatures are 80 K. in the first stage, 20 K. in the second stage and 4.5 K. in the third stage. In the first and second stage heat exchangers, precooling of the incoming fluid occurs by a combination of both regenerative heat exchange and counterflow heat exchange, while precooling in the third stage occurs primarily by counterflow heat exchange.

Figure 2:
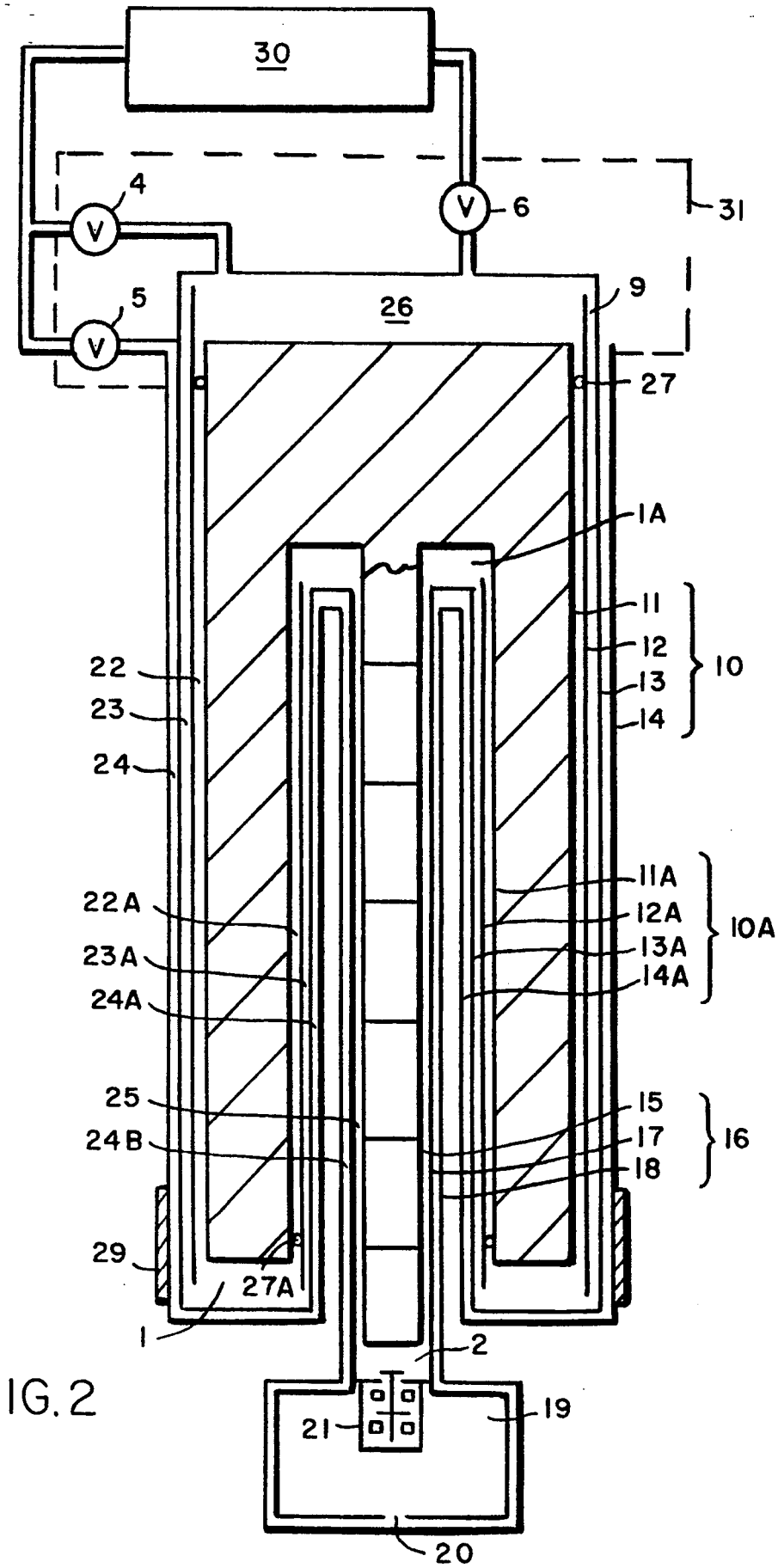
FIG. 2 shows a diagrammatic view of more compact embodiment of a refrigeration system in accordance with the invention.

FIG. 2 depicts a more compact three-stage, folded configuration of the system of FIG. 1, with the primary components being identical. In the configuration of FIG. 1, the available spaces inside pistons 11 and 11A are not used. In FIG. 2, the second stage has been inverted with respect to, and is folded into, the first stage, and the third stage has been inverted with respect to, and is folded into, the second stage. This inverting or folding of the stages reduces the overall length of the system.

Improved heat transfer has been developed for the precooling heat exchangers in both the warmer and cooler stages by using uniquely configured channels in each of such stages therein. Such uniquely configured channels can be inexpensively fabricated using well-known machining techniques. The channel configurations provide for continuous mixing of the fluid as it flows along the heat exchanger length. The channel through which the fluid passes is constructed by machining a particular pattern of flow passages at the outer surface of the inner tube of the channel and then fitting an outer tube onto the inner tube leaving no clearance between the outer and inner tubes and thereby forcing the fluid to flow through the machined flow pattern.

The channel can be fabricated using machining processes such as chemical etching or knurling. Alternately, the flow patterns can be fabricated by electrical discharge machining (EDM), a technique well known to the art. The electrode, typically a block of graphite or copper, is machined to be the mirror image of the surface to be produced. A typical set up of the EDM process would rotate the tube while the electrode is traversed tangent to the tube.

This flow pattern can also be fabricated using a chemical machining process. An appropriate etchant is selected based upon the material to be etched, the type of masking material used, the depth of the etch, the surface finish required, and several other factors. In this technique, areas not to be exposed to the etchant are coated with a masking or etch resist material. The etchant is then typically sprayed onto the surface to chemically remove the metal where the resist is not present. Although the etching rate is typically limited to 0.001 to 0.003 inches per minute, large areas can be worked simultaneously so that overall metal removal rates can be quite high.

In accordance with the invention, as mentioned above, an appropriately selected pattern is machined onto the outer surface of an inner tube. An outer tube is then tightly fitted onto the outer surface of the inner tube, typically by a thermal shrinking process. The fluid is then forced to flow through the chemically machined pattern. This machining process provides a consistent, torturous-path flow passage at a reasonable manufacturing cost. Repeatability of these processes can be effectively controlled, e.g., to within 0.0005 inches, which ensures minimal variations in gap width for a single flow passage and for a complete batch of tubes of a single flow passage. This repeatability allows for minimal flow maldistribution in a single flow channel and provides minimal variations in expected pressure drops among heat exchangers when producing many identical tubes for use in providing a single flow channel for many different systems.

Figure 3:
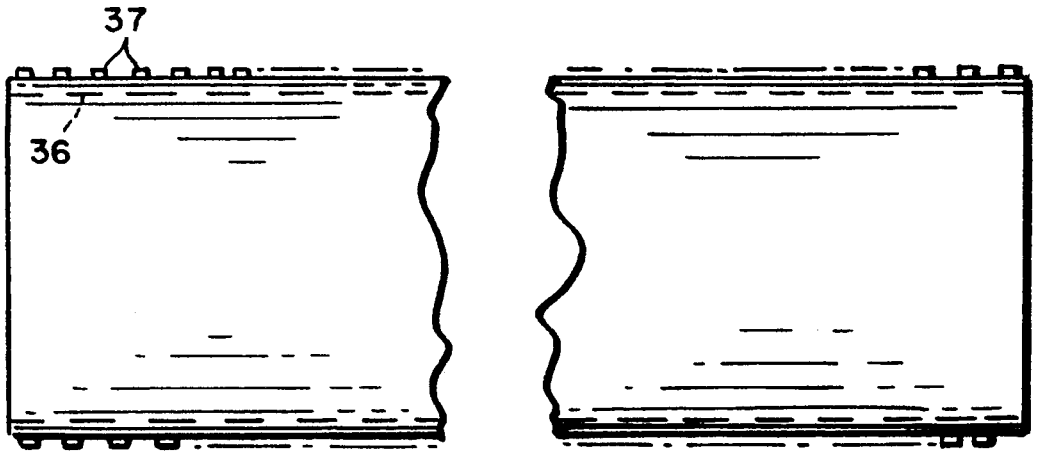
FIGS. 3, 3A and 3B show diagrammatic views of a staggered pin heat exchanger useful in the embodiments of FIGS. 1 or 2.
Figure 3B:
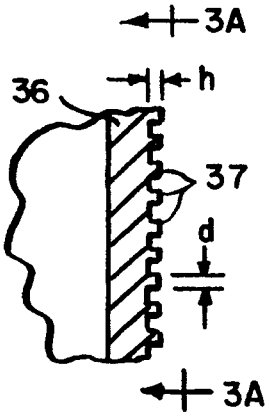
Figure 3A:
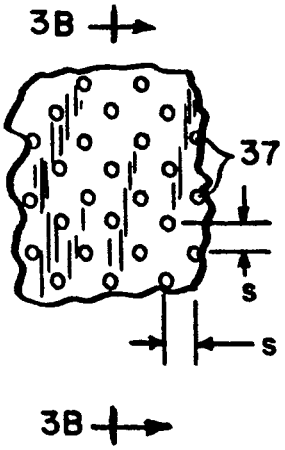

A chemical machining or EDM process allows the designer to choose from a variety of flow patterns to provide a machined surface for continuously mixing the fluid as it flows along the heat exchanger length. An example of such a machined surface is obtained by removing metal from the outside of a tube 36 in a manner so as to leave small circular pins 37 extending from the tube, as shown in FIGS. 3A and 3B. Staggering the pins in the direction of Elow with appropriate spacing, as shown in FIG. 3A, produces a fluid mixing effect. This configuration can be referred to as a "staggered pin" heat exchanger. Typical pin dimensions and spacing for such a heat exchanger are shown in FIGS. 3A and 3B, wherein the diameter d of the pins is 0.015 inches, the height h thereof is 0.014 inches, and the spacing thereof is 0.032 inches.

As a comparison with the spiraled passage heat exchanger disclosed in the aforesaid Crunkleton patent, it has been found that the staggered pin heat exchanger provides more efficient heat exchange for similar pressure drops when the systems operate under similar mass flow and temperature range conditions. In addition, the staggered pin configuration, which continuously mixes the flow, is more easily designed for predictable performance than the spiraled passage configuration, where transitions between laminar and turbulent flow conditions are not easily predicted.

To further increase heat exchanger performance, a combination of materials can be used in a single tube having such staggered pin configuration. Thus, to increase thermal conductivity in the radial direction without increasing axial conduction, a high-thermal conductivity pin material, such as copper, can be used in combination with a lower-thermal conductivity base tube material, such as stainless steel. For example, a stainless steel tube can be coated with copper before the etching process. All of the copper is then etched away except for the copper pins.

In further accordance with the invention, each integral heat exchanger and expansion engine of a refrigeration system is specially designed to minimize effects of the prevailing loss mechanisms within the range of operating temperatures thereof. In the warmer stages, where shuttle heat leak losses may be considerable, the invention is arranged to thermally decouple the piston-to-cylinder gap from the input side of the heat exchanger by providing a separate passage for the heat exchange operation. In this way, improvements in heat transfer in the input fluid flow passage do not simultaneously increase the shuttle heat leak loss. This arrangement also eliminates flow maldistribution effects in the input flow passage that may occur from piston-to-cylinder gap nonuniformities.

As shown in FIG. 1 and FIG. 2, a heat exchange arrangement consisting of four concentric tubes is used in the first and second warmer stages to thermally decouple the piston-to-cylinder gap from the input side of the heat exchanger. In FIG. 1, the inner-most tubes are the vacuum-filled pistons 11 and 11A which move reciprocally inside of cylinder tubes 12 and 12A, respectively. The input fluid flows between the cylinders 12 and 12A and the heat exchanger tubes 13 and 13A surrounding such cylinders. The constant-pressure output channels 24 and 24A consist of the heat exchanger tubes 13 and 13A and the outer shell tubes 14 and 14A, respectively.

This four-tube arrangement allows the use of mixed flow heat exchange passages, such as the staggered pin heat exchanger passage discussed with reference to FIGS. 3, 3A, and 3B, for both the input and output flow channels. Thus, channels to provide continuous mixing of the fluid are machined onto the outer surfaces of the cylinder tubes 12 and 12A and the outer surfaces of heat exchanger tubes 13 and 13A, as shown in FIG. 1. In FIG. 2, since the second stage is inverted with respect to the first stage, the outer surfaces of tubes 14A and 13A are machined. Tube 12A is smooth both inside and out.

The four-tube arrangement increases the volume that must be pressurized and depressurized each cycle without performing any net cooling. This volume, commonly referred to as dead volume, includes any volume that undergoes pressure cycling other than the working expander volumes themselves. Increasing the dead volume increases the amount of mass throttled from a higher pressure to a lower pressure to pressurize the dead volume when the intake valve opens. This pressurization loss results in the need for an increased mass flow rate which increases the compressor power. Thus, for a specified refrigeration load, it is desirable to minimize the frequency at which the dead volume is pressurized.

Because the input channels are parallel to the piston-to-cylinder gaps in the four-tube arrangement, sliding seals 27 and 27A must be placed in the piston-to-cylinder gaps to result in preferred flow passages between the cylinder and heat exchanger tubes.

Another configuration that thermally decouples the piston-to-cylinder gap from the input passage uses a heat exchanger that is physically separated from the multi-stage piston and cylinder expander. Rather than using the outer surface of the cylinder as a heat exchanger surface, a separate heat exchanger having a high surface area is used at the first stage 10 of the system, the separate heat exchanger being coupled to the expansion volume by some appropriate flow passage means, such as a small-diameter tube. While this configuration has the disadvantage that it may not be as compact as an integrally formed heat exchanger and expansion engine configuration, such a separate heat exchanger allows for the use of different heat exchanger geometries, such as a stacked-screen heat exchanger which is well-known to those in the art. While stacked screen exchangers have large heat exchange surface areas, other high surface area heat exchangers known to the art can also be used.

Figure 4:
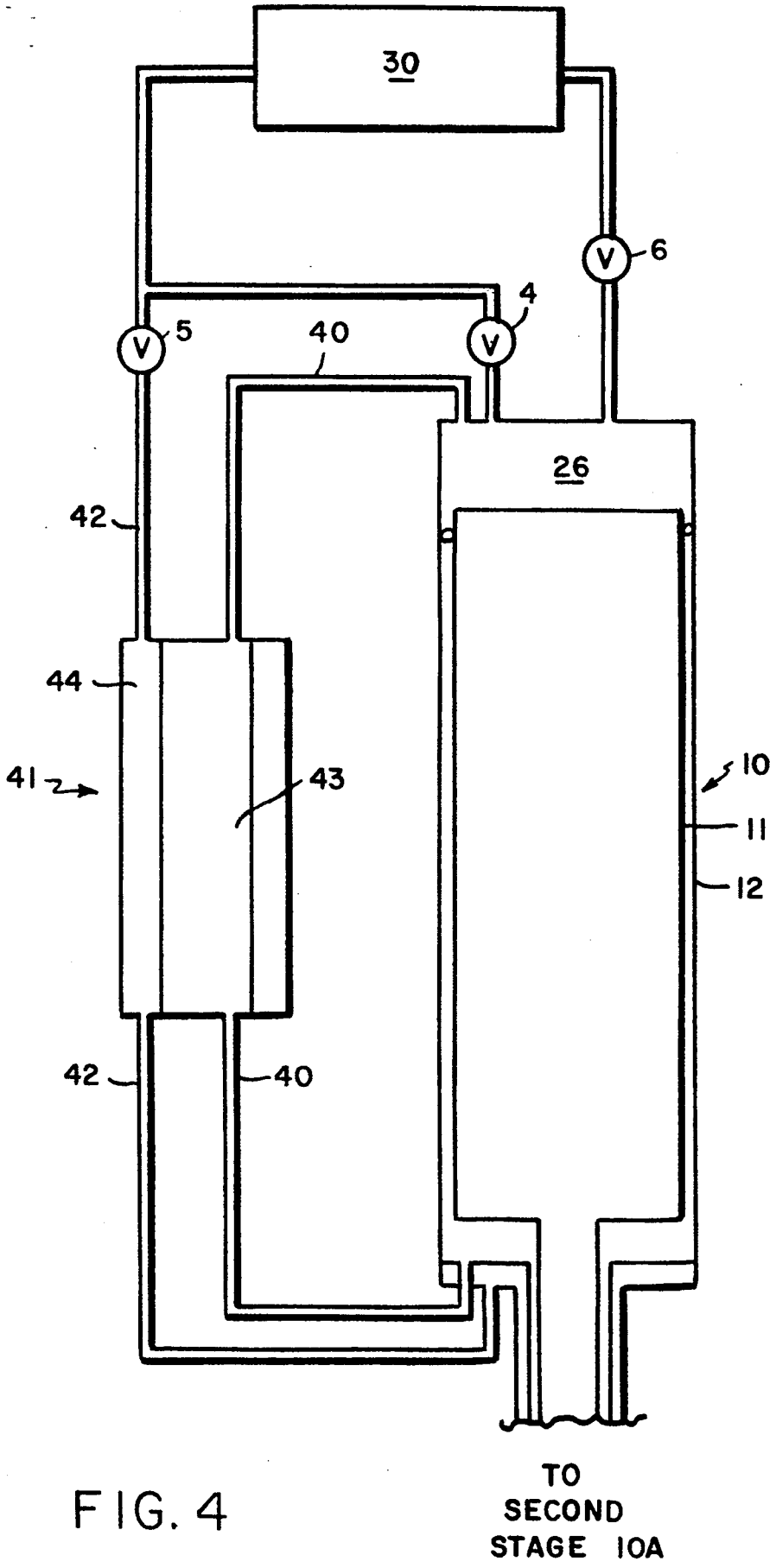
FIG. 4 shows a diagrammatic view of an alternative, external stacked-screen heat exchanger for the first refrigeration stage of FIG. 1.

An example of this configuration is shown in FIG. 4. As seen therein, high pressure input fluid from compressor 30 is supplied to an input channel 40 at the first stage 10. Channel 40 is physically decoupled from the piston 11 and cylinder 12 via intake valve 6. Heat exchange in the first stage 10 is achieved using a stacked-screen heat exchanger 41 in a first stage, input fluid flowing from an upper input channel 40 through an input stacked-screen portion 43 of heat exchanger 41 and out the lower input channel 40 to the working volume 1 of first stage 10. The output channel 42 at the first stage is also physically decoupled from the piston/cylinder, as shown, and output fluid flows from lower output channel 42 through an annular shaped output stacked-screen portion 44 of heat exchanger 41 to upper output channel 42. Thus, stacked screens are used in both the input and output channels of the first heat exchanger stage 10, which channels are physically decoupled from the expansion engine i.e., the moving piston of such stage. Similar high surface area heat exchangers can also be used at the other warmer stages of the system.

In further accordance with the invention, it is recognized that the colder stages operating below about 20 Kelvin are subject to different physical phenomena than the warmer stages, such colder stages, for example, having greatly-reduced thermal conductivities and heat capacities of the metal walls. Shuttle heat transfer and axial conduction are no longer the dominant heat loss mechanisms, so the colder stages can be designed without need to use a four-tube arrangement. Thus, as shown in FIG. 1 and FIG. 2, in such stages the piston-to-cylinder gap is used as the input passage and no sliding seals are necessary.

Figure 5:
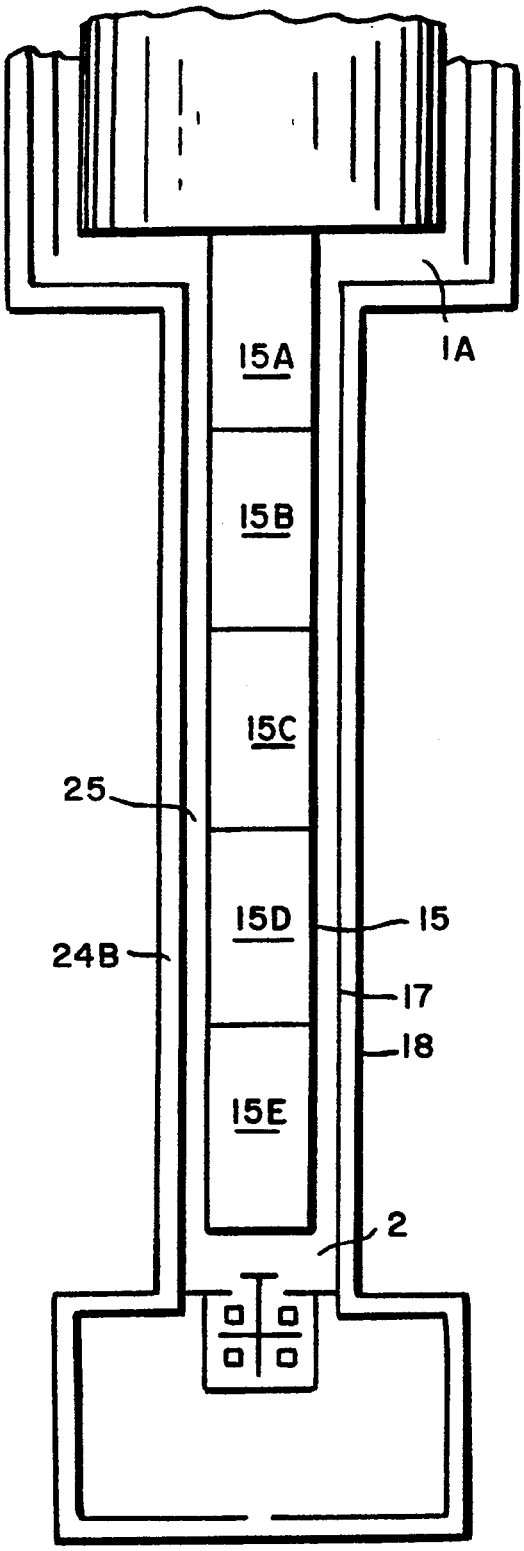
FIG. 5 shows a diagrammatic view of a solid, segmented piston at the colder stage of a system of FIGS. 1 or 2.

In order to provide increased performance and ease of manufacture in the colder stages of a multi-stage system, a solid, segmented piston 15 is used. In a particular embodiment, for example, the diametral piston-to-cylinder gap in the cold stage must typically be in a range from about 0.0005 to about 0.003 inches to provide adequate heat exchange performance and to provide a minimal dead volume. If the piston and cylinder are made of thin-walled tubing, difficult fabrication techniques are required to maintain adequate straightness over the entire heat exchanger length, which can be, for example, 20 times the piston diameter, to provide minimal piston-to-cylinder gap variations. In a solid, segmented piston arrangement, such as shown in the exemplary embodiment of FIG. 5, the segment lengths 15A–15E are typically one to five times the piston diameter and are individually centered inside the cylinder 17 using appropriate centering means. The segments are connected with flexible joints designed to allow the piston to provide reasonable cylinder straightness, i.e., minimal piston-to-cylinder gaps, at each segment without creating excessive dead volume. Because each segment can be and is individually centered, flow maldistribution in the piston-to-cylinder gap is small. Further, if materials having very-low thermal conductivity below 20 K., such as stainless steel, are used, solid piston segments result in a negligible axial conduction heat leak.

The use of a stainless steel cylinder as the heat exchanger wall, however, tends to result in a relatively large thermal conduction resistance in the wall between the input and low-pressure output streams. In order to improve the stream-to-stream conduction without creating excessive axial conduction, a material other than stainless steel may be used. For example, using 1020 carbon steel, a material with a relatively high thermal conductivity, as the material for the cylinder 17 of FIG. 1 and FIG. 2 decreases the conductive wall resistance by approximately one order of magnitude, while providing an acceptably-low level of axial conduction.

In an ideal case of the refrigeration process discussed above, the flows of fluid mass into and out of the expansion volumes occurs only during constant-pressure intake and exhaust portions of the cycle, while no fluid mass flows occur during the expansion and recompression portions thereof. In this way, ideally all mass entering an expansion volume enters at the maximum intake pressure and is fully expanded to the minimum exhaust pressure before leaving the volume. Such an operation can be referred to as operation under ideal mass flow conditions. However, because the fluid properties vary over the temperature ranges occurring throughout the system (i.e., helium is an ideal gas only in the warmer stages of such a multi-stage refrigerator), and because fluid in the expansion volumes undergoes different amounts of adiabatic and/or isothermal expansion processes depending on the operating temperatures of the expansion stage, obtaining ideal mass flow conditions in the input channels of a multi-stage refrigerator requires special operation or hardware modifications.

In the case of a two-stage system, such as described in the aforesaid patents and discussed above, for example, the warmer stage operates at 50 Kelvin, where helium properties are such that it acts as a near ideal gas, and the colder stage operates at 4.5 Kelvin. If no mass leaves or enters either expansion volume during an expansion process and if both expansion volumes are displaced simultaneously, the warmer stage pressure versus position curve follows a much less steep slope than that for the colder stage. Accordingly, the pressure in the warmer stage is higher during portions of expansion than the pressure in the colder stage. In this case, mass would flow from the warmer stage to the colder stage in the absence of some mass flow barrier, whereas, as mentioned above, under ideal mass flow conditions, no mass would flow between such stages during expansion. It is desirable then to devise a technique for assuring ideal or near ideal mass flow conditions in the system.

One technique for achieving ideal or near ideal mass flow conditions in accordance with the invention is to displace each expansion volume in such a manner as to produce no mass flow at some axial location in each connecting precooling heat exchanger during the expansion and recompression processes. Configurations embodying various techniques for such purpose in the three-stage refrigerator system shown in FIG. 1 and FIG. 2 are depicted in FIGS. 6, 6A, and 6B.

Figure 6:
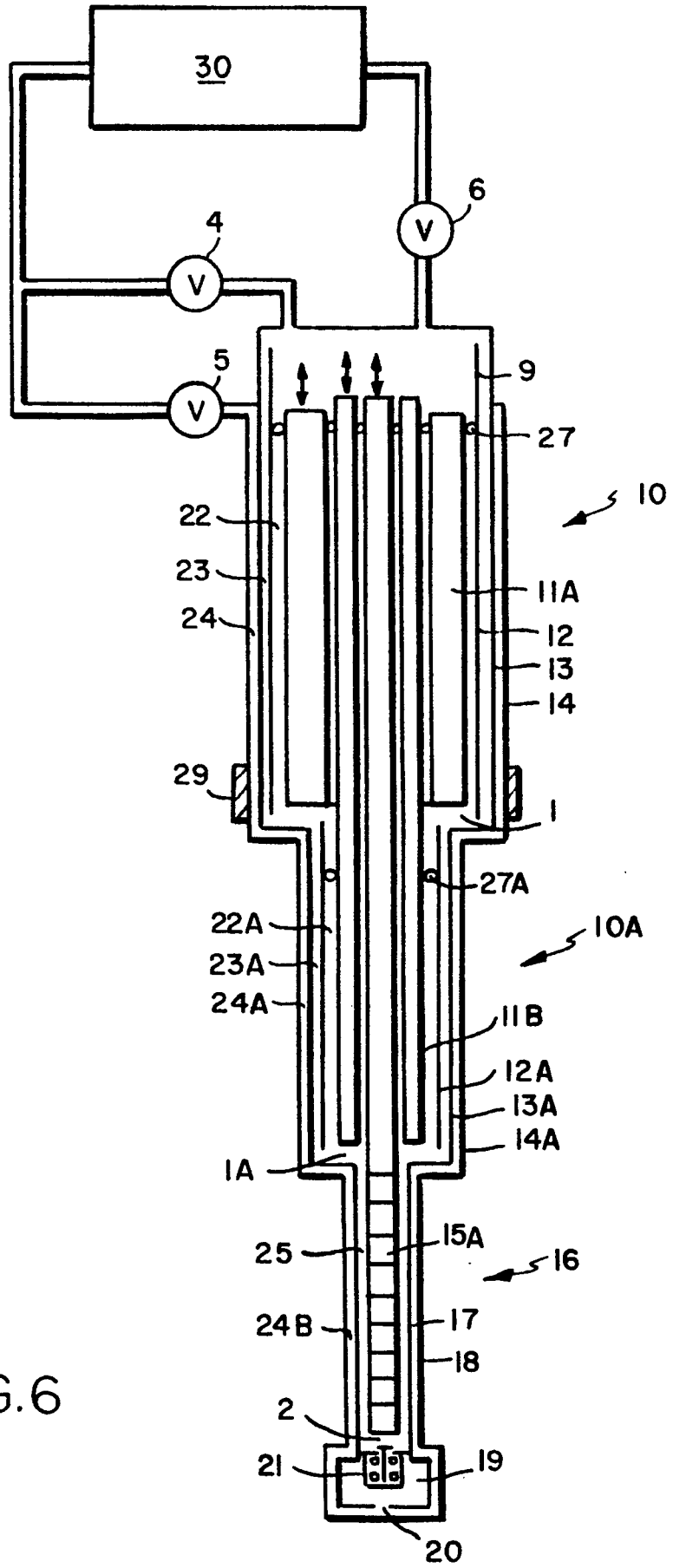
FIG. 6 shows a diagrammatic view of a three-stage refrigerator system using three independent pistons in accordance with the invention.

As shown in FIG. 6, such ideal operation requires use of a separate piston for each expansion volume, where each separate piston is displaced at the same cyclic frequency but is allowed to have individualized position versus time traces. Thus, a first piston 11A is used at stage 10, while a second piston 11B, separate from piston 11A, is used at stage 10A, and a third piston 15A, separate from both pistons 11A and 11B, is used at stage 16, piston 15A being segmented at its lower end at stage 16. Suitable sliding seals 27 and 27A used between the separate pistons, as shown in FIG. 6.

Figure 6A:
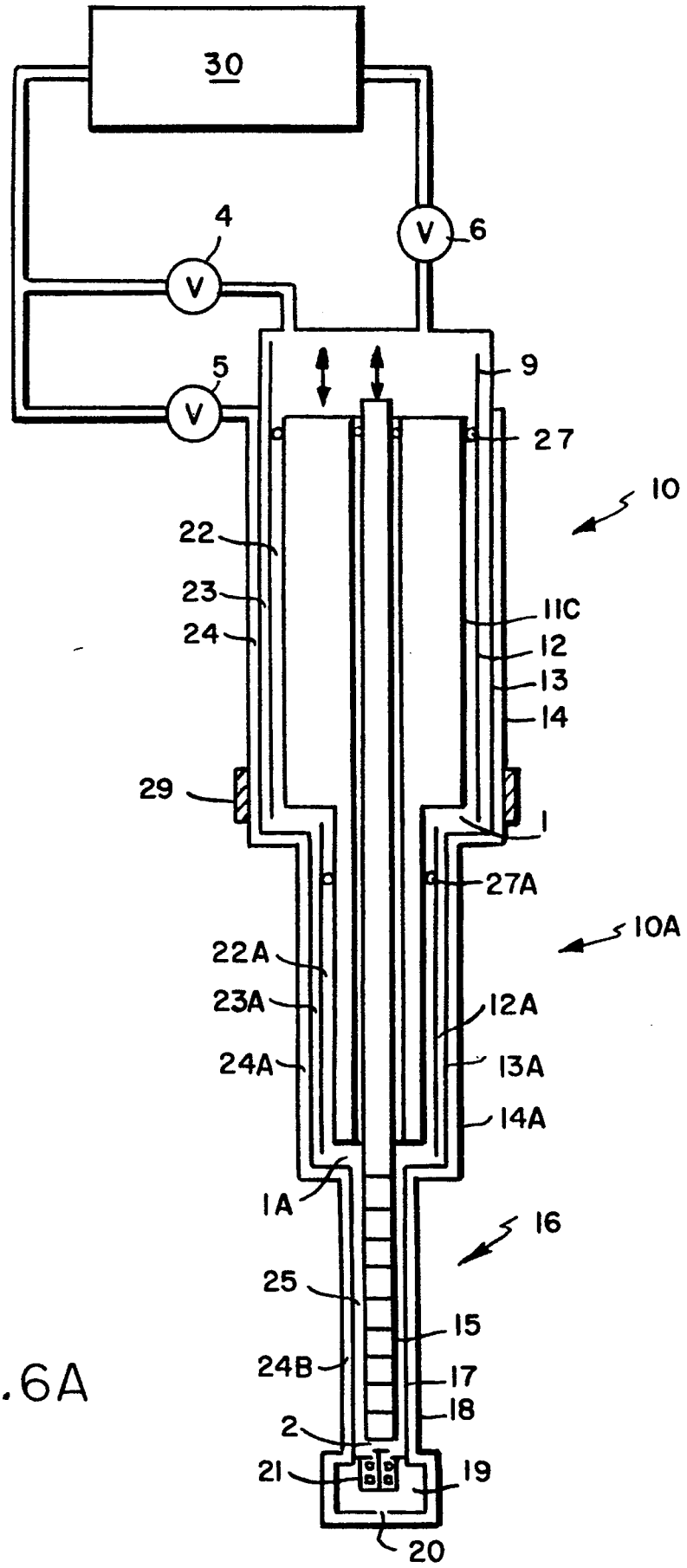
FIG. 6A shows a diagrammatic view of a three-stage refrigerator system using two independent pistons in accordance with the invention.
Figure 6B:
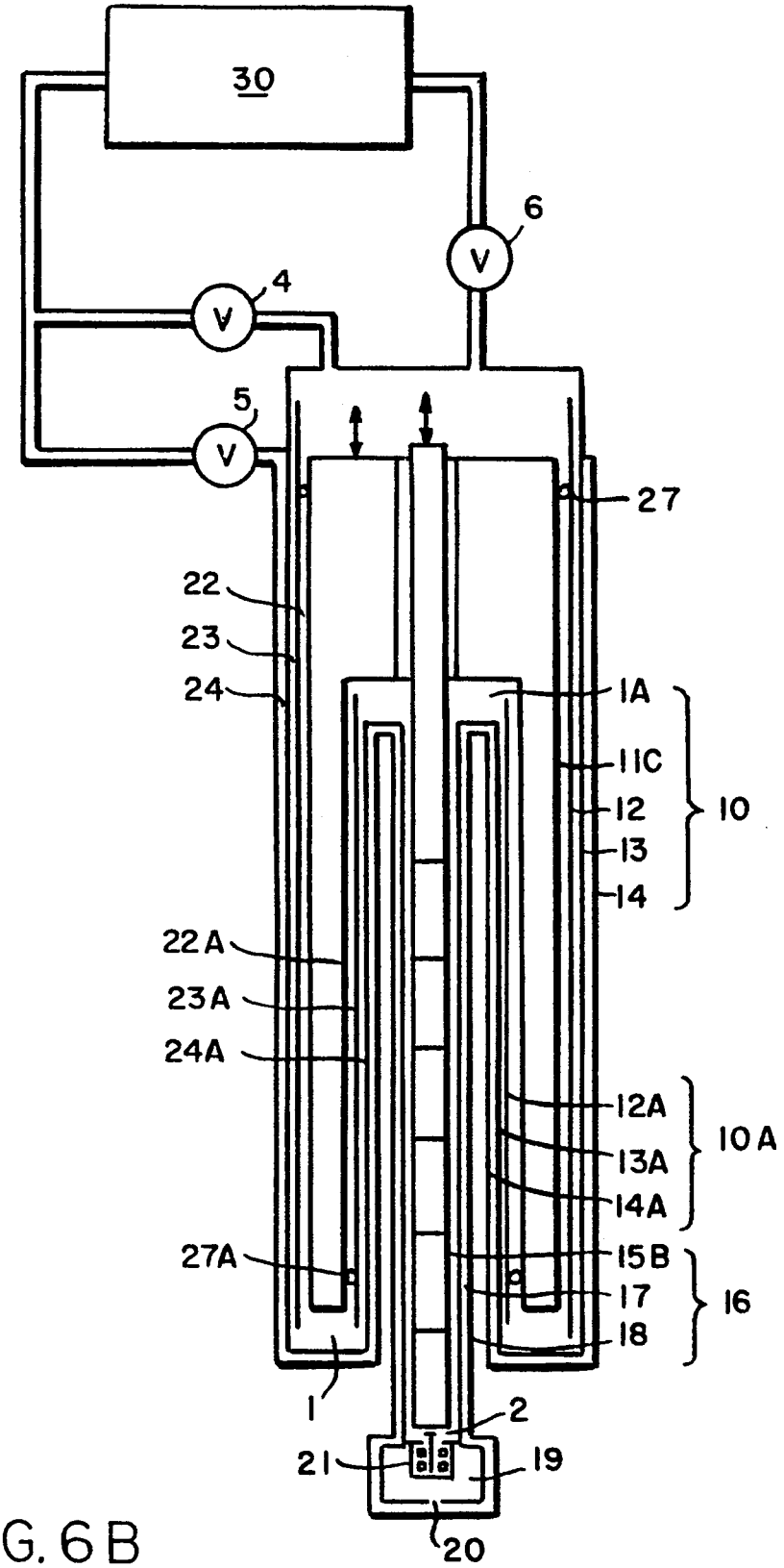
FIG. 6B shows a diagrammatic view of a more compact three-stage refrigerator using two independent pistons in accordance with the invention.

Other configurations shown in FIG. 6A and FIG. 6B tend to provide less than optimal or ideal flow conditions, but require fewer discrete pistons. Thus, in both FIG. 6A and the folded configuration of FIG. 6B, the warmer stages 10 and 10A use a single interconnected piston 11C and the colder stage uses a separate piston 15B. In such cases, the colder stage is displaced with essentially ideal mass flow conditions, but the warmer stages may operate at less than optimal or ideal conditions.

A disadvantage of the configurations shown in FIGS. 6, 6A and 6B is the greater complexity required in the drive mechanism in order to properly control the motion of the individual pistons.

Additional mass flow control can be obtained in the third colder stage by properly selecting the piston-to-cylinder gap therein to minimize the mass flow between the cold stage and the upper stages at low pressures. During the later portion of the expansion part of the cycles when the refrigerant fluid (e.g., helium) enters the two-phase region, the fluid suddenly becomes much more compressible. Because pressures in all expansion volumes tend to equilibrate, the more compressible fluid in the cold stage tends to flow upward toward the warmer stages. This results in two-phase fluid leaving the expansion volume via the piston-to-cylinder gap, thereby reducing the amount of two-phase fluid exiting the expansion volume through the cold valve to enter the cold surge volume of the load heat exchanger. Since the third-stage heat exchanger has so little heat capacity, much of the cooling capabilities of this fluid is lost. To limit the amount of fluid leaving the cold stage at low pressures at a point in the cycle before the cold exhaust valve opens, the piston-to-cylinder gap is designed to be as small as practical without excessively impeding the intake flow at much higher pressure. The use of such a small gap results in second and third stage expansion-volume pressures that are different during portions of the cycle. In this case, it has been found that a radial gap in the range from 0.00025 in. to 0.0015 in. has proved effective in preventing a reverse flow of fluid from the cold to the warmer stages.

Maximum counterflow heat exchanger performance requires minimal heat capacity mismatch between the counterflow streams in order to limit heat exchange temperature differences during a steady mass flow and to limit temperature swings during fluctuations in mass flow rate. This requirement is amplified in the third stage because very little heat capacity is available for regenerative heat exchange. In the ideal case of matched heat capacities between counterflow streams, the product of mass flow rate and specific heat capacity is always equal at each axial location along a counterflow heat exchanger. If available, regenerative heat capacity can minimize temperature swings during mass flow rate fluctuations, as long as the average of the product of mass flow rate and specific heat capacity is equal for the two streams over a cycle. Because the specific heat capacity of helium in the third stage varies considerably as a function of temperature and pressure, achieving perfectly matched heat capacity flow rates is not practical. However, the heat capacity mismatch can be greatly reduced by allowing intermittent low pressure mass flow in the output channel only during mass flow in the input channel, which operation more nearly matches heat capacity flow rates at each axial location in the cold stage heat exchanger, thereby limiting the magnitude of temperature swings. To achieve an intermittent low-pressure flow in the output channel so as to occur simultaneously with mass flow in the input channel, an additional valve means 5 is used in the output channel. Preferably, valve 5 is placed at the room-temperature end of the output channel, as shown in FIG. 1 and FIG. 2.

A combination of valves and flow restrictions at the room-temperature end of the coldhead are used to tailor mass flows to the working volumes in order to achieve efficient operation as discussed above. Each valve ideally operates in either a fully open or a fully closed state, i.e., with no flow restriction when open and with infinite flow restriction when closed. A valve normally governs when mass flow occurs, while a flow restriction governs the mass flow rate. For example, a valve can be a spool, or a poppet valve and the flow restriction can be an orifice, or a needle valve. Ideally, the valve and flow restriction functions are integrated into a single mechanical means, as illustrated in FIG. 1 and FIG. 2 as valves 4, 5, and 6. The specific valve and flow restriction combinations required in a particular embodiment depend on the overall system specifications (e.g., cooling requirements, load temperatures, pressure ratios) and component selections (e.g., drive mechanism, heat exchangers, compressor) and can be determined by a system designer.

Heat loads from the environment can be supplied to any stage of the system via a suitable load heat exchanger. The function of the load heat exchanger is to accept a heat load from the environment and to transfer the heat therefrom into the operating fluid in an efficient manner. Typically, a low-pressure operating fluid is placed in close contact with the heat load, which technique may be implemented with many different heat exchanger configurations, the final choice depending upon such parameters as the magnitude of the heat load, the cost of fabrication of the heat exchanger, the interface with environment, and the degree of compactness required for the particular application in which the system is to be used.

For fluid exiting through a cold exhaust valve 21, effective load heat exchangers can be designed as discussed in more detail below with reference to FIGS. 7 and 8. In such a case, because the heat capacity is very small in a load heat exchanger operating below 20 K., particularly at liquid-helium temperatures, and because the magnitude of the environmental load typically varies very little during a single cycle of operation, a constant mass flow rate through the load heat exchanger is highly desirable to limit temperature fluctuations if temperature stability is desirable in the application. It should be noted that two-phase fluid in the load heat exchanger does not provide sufficient heat capacity to limit temperature fluctuations unless the latent heat of vaporization of stored liquid in the flow passage is comparable in magnitude to the applied load during the period of no mass flow. This operation is in contrast with the mass flow rate in the output channel, which is intermittent so as to coincide with mass flow in the input channel in the coldest stage precooling heat exchanger, e.g., the third stage 16 of the three stage embodiment depicted in FIG. 1 and FIG. 2. To achieve relatively constant flow in the load heat exchanger and intermittent flow in the output channel requires mass storage volumes at the inlet and outlet of the load heat exchanger.

In contrast, warmer stage load heat exchangers typically do not share this same requirement because the heat capacity of the heat exchanger walls is sufficient to prevent significant temperature swings. In the warmer stages, where the precooling heat exchangers use a combination of both counterflow and regenerative heat exchange, a load heat exchanger 29, as shown at first stage 10, for example, in FIGS. 1 and 2, is closely coupled to the low-pressure output channel. Thus, the heat load from the environment is supplied to a high thermal conductivity means, such as a copper mass in the form of a copper band 29, which is directly coupled to and contacts the outer surface of the output channel at a warmer stage 10. This high thermal conductivity means isothermalizes a sufficient portion of the precooling heat exchanger to limit the temperature difference between the environmental load and the fluid in the output channel. A similar load heat exchanger can also be used, if desired, at warmer stage 10A.

Figure 7:
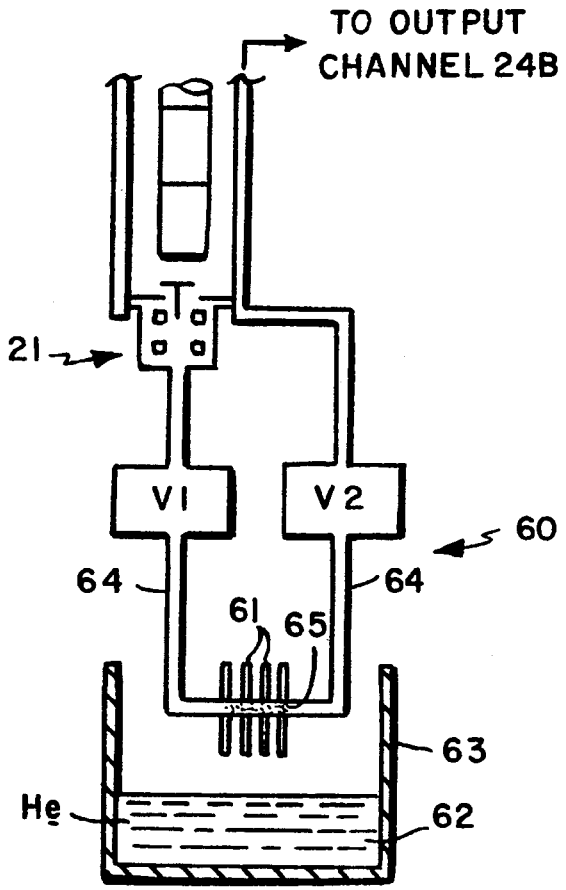
FIG. 7 shows a diagrammatic view depicting an approach to providing an effective load heat exchanger at the cold end of a system in accordance with the invention.
Figure 8:
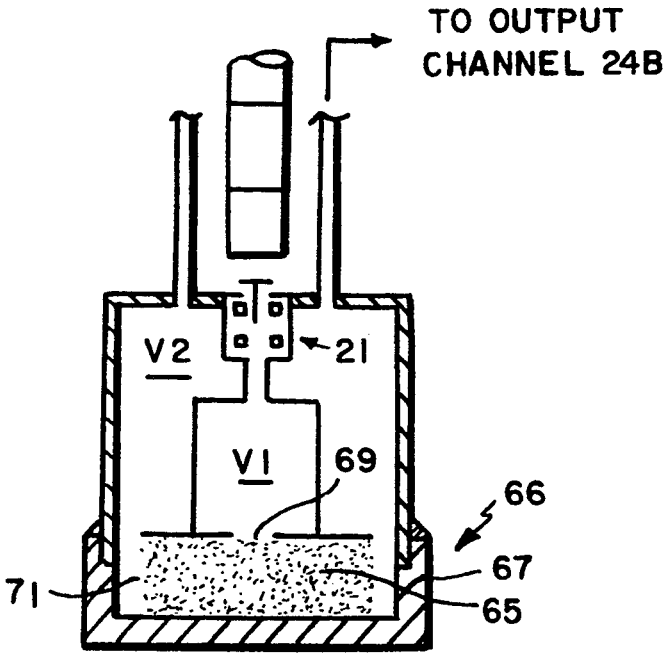
FIG. 8 shows a diagrammatic view depicting another approach to providing an effective load heat exchanger at the cold end of a system in accordance with the invention.

Two effective load heat exchangers for use, for example, at the colder stage 16 of FIGS. 1 and 2 are shown in FIGS. 7 and 8.

In the embodiment of FIG. 7, a load, e.g., a magnet (not shown), is immersed in a bath 62 of liquid helium which is in a suitable container 63 positioned adjacent to load heat exchanger 60. In the load heat exchanger, output working fluid in the system at low temperature and low pressure is supplied from cold valve 21 to a first accumulator V1 from which the fluid in a two-phase state (partially gaseous and partially liquid) is supplied to a channel 64 having a plurality of finned surfaces 61 affixed thereto as shown.

The interior of channel 64, in close proximity to the fins, is filled with a fine matrix of sintered spheres having a high thermal conductivity, such as copper spheres 65. The sintered spheres present a large isothermal surface area to the fluid flowing in channel 64. Heat from the load causes the liquid helium in bath 62 to vaporize, the helium gas recondensing at finned surfaces 61 and returning in liquid form to bath 62, thereby transferring heat from the load to the output working fluid of the system which vaporizes in channel 64. The fins and sintered spheres minimize the temperature differential between fluid in channel 64 and bath 62. The output fluid in channel 64 thereupon is supplied as a saturated gas to an accumulator V2 and thence to output channel 24B as shown. The accumulators V1 and V2 effectively act to provide a steady flow of fluid from valve 21 to output channel 24B, effectively acting as mechanical filters to fluid flow in a manner equivalent to electrical resistance-capacitance filters for electrical current flow in an electric circuit. The embodiment of FIG. 7 provides an effective coupling of the load heat exchanger 60 to the load which is in liquid helium bath 62 so as to produce an efficient transfer of heat from the load to the working fluid of the system, thereby providing for the desired cooling of the load.

Another effective load heat exchanger configuration is shown in FIG. 8 in which an effectively direct contact is provided between the working fluid and a load. Low pressure, low temperature working fluid is supplied via cold valve 21 to an accumulator V1 and thence to a heat exchange structure 66 comprising a copper housing 67 attached to the lower end of an accumulator V2 and having a matrix of sintered sphere elements having a high thermal conductivity, such as copper sphere elements 65 mounted therein. The lower surface of accumulator V2 has a load (not shown) placed in direct contact with copper member 67.

Fluid in a two-phase state is supplied from accumulator V1 to the sintered copper elements 65 via an aperture 69 and a transfer of heat from the load to the two-phase fluid occurs. The two-phase fluid is thereupon vaporized to produce a saturated gas which is supplied via aperture 71 to accumulator V2 and thence to output channel 24B. Accordingly, an efficient transfer of heat from the load to the working fluid occurs, thereby providing for the desired cooling of the load.

While the above embodiments of the system of the invention and portions thereof represent preferred embodiments thereof, modifications thereto may occur to those in the art within the spirit and scope of the invention. Hence, the invention is not to be construed as limited to the specific embodiments shown and discussed herein, except as defined by the appended claims.

What is claimed is:

1. A system for producing a cold environment comprising fluid compression means for supplying fluid under pressure;

a plurality of successive operating stages having variable displacement volumes;

volume-changing means for varying the volumes of said displacement volumes;

input channel means for permitting flow of fluid to and from said successive displacement volumes;

first means for permitting input fluid to be introduced under pressure from said fluid compression means into said input channel means for flow therein to said successive displacement volumes;

second means for permitting fluid in said input channel means to flow to said fluid compression means;

third means for permitting fluid at reduced pressure to flow from the final one of said displacement volumes into an output channel means, said output channel means permitting flow of output fluid to said fluid compression means;

whereby input fluid flowing from said fluid compression means under pressure in said input channel means to said first set of displacement volumes is pre-cooled by regenerative heat exchange with a portion of the structure of said input channel and by counterflow heat exchange with fluid flowing in said output channel means, and input fluid flowing in said input channel means to said final one of said displacement volumes is pre-cooled primarily by counterflow heat exchange with fluid flowing in said output channel; and means for thermally decoupling the volume changing means of at least one of said successive operating stages from said input and said output channel means.

2. A system in accordance with claim 1 wherein at least one of said successive operating stages is formed as four concentric means which comprise a cylindrical piston means and first, second, and third cylindrical tubular means concentrically mounted with respect to each other and to said cylindrical piston means, said piston means moving reciprocally with respect to said first cylindrical tubular means, said input channel means being formed between said first tubular means and said concentric second tubular means, and said output channel means being formed between said second tubular means and said third tubular means.

3. A system in accordance with claim 2 wherein each of said one or more stages includes a sliding seal means positioned between said piston means and said first cylindrical tubular means.

4. A system in accordance with claim 2 and further including means for producing a selected flow pattern in at least one of said input and output channel means.

5. A system in accordance with claim 4 wherein said flow pattern producing means comprises a plurality of elements positioned in at least one of said input and output flow channel means.

6. A system in accordance with claim 5 wherein said elements comprise a plurality of pin elements positioned in a staggered manner on the surface of at least one of said first and second tubular means.

7. A system in accordance with claim 1 and further including means for producing a selected flow pattern in at least one of said input and output channel means.

8. A system in accordance with claim 7 wherein said flow pattern producing means comprises a plurality of elements positioned in at least one of said input and output flow channel means.

9. A system in accordance with claim 8 wherein said elements are formed of a different material than that of said tubular means.

10. A system in accordance with claim 1 wherein at least one of said successive operating stages comprises a cylindrical piston means and a concentric cylindrical tubular means, said piston means moving in a reciprocal manner with respect to said cylindrical tubular means, and said decoupling means comprises a separate heat exchanger means which includes the input channel means and output channel means at said at least one operating stage.

11. A system in accordance with claim 10 wherein said separate heat exchanger means is a stacked screen heat exchanger.

12. A system in accordance with claim 10 wherein at least one stage includes a sliding seal positioned between said piston means and said cylindrical tubular means.

13. A system in accordance with claims 1, 2, or 10 wherein each of said operating stages other than said final stage includes tubular piston means and said final stage includes a solid cylindrical piston means, said tubular piston means and solid piston means being connected to each other.

14. A system in accordance with claim 13 wherein the solid cylindrical piston means of said final stage comprises a plurality of solid cylindrical segments coupled to each other by flexible joints.

15. A system in accordance with claim 14 where in said solid cylindrical segments are made of a material having a relatively low thermal conductivity.

16. A system in accordance with claim 15 wherein said material is stainless steel.

17. A system in accordance with claim 14, wherein said final stage includes centering means associated with each of said solid cylindrical segments for positioning said segments substantially concentrically within the cylindrical tubular means.

18. A system in accordance with claims 1, 2, or 10 wherein the volume-changing means at the final one of said successive operating stages includes a piston means moving reciprocally within a cylindrical tubular means, said cylindrical tubular means being made of a material having a relatively high thermal conductivity.

19. A system in accordance with claim 18, wherein said material is low carbon steel.

20. A system in accordance with claims 1, 2, or 10 wherein said system includes first, second and third successive operating stages, each stage including volume-changing means, input channel means and output channel means, said second stage extending spatially from said first stage and said third stage extending spatially from said second stage.

21. A system in accordance with claims 1, 2, or 10 wherein said system includes first, second and third successive operating stages, each stage including volume-changing means, input channel means and output channel means, said third stage being invertedly positioned within said second stage and said second and third stages being invertedly positioned within said first stage.

22. A system in accordance with claims 1, 2, or 10 wherein said volume-changing means includes separate, independently operating piston means in each of said successive operating stages,the piston means at each stage being moved at the same cyclic frequency to provide variable displacement volumes, and the positions of each said piston means as a function of time being independently selectable for each piston means.

23. A system in accordance with claim 22 and further including sliding seal means positioned between said separate piston means.

24. A system in accordance with claims 1, 2, or 10 wherein said volume-changing means include integrally formed and commonly operated piston means in a selected number of said successive stages and separately formed, independently operated piston means in the remaining ones of said successive stages.

25. A system in accordance with claim 24, wherein integrally formed, commonly operated piston means are used at all stages other than the final stage of said system and a separately formed, independently operated piston means is used at the final stage of said system.

26. A system in accordance with claims 1, 2, or 10 wherein said third means includes a valve which can operate at a temperature substantially below room temperature.

27. A system in accordance with claim 26 and further including a first volume means positioned between said valve means and said output channel means.

28. A system in accordance with claim 27 and further including a load contacting heat exchanger means coupled to said first volume means for providing enhanced thermal contact with a thermal load; and a second volume means coupled to said heat exchanger means and to said output channel means.

29. A system in accordance with claim 28 wherein said heat exchanger means includes means for providing a direct thermal contact with said thermal load.

30. A system in accordance with claim 29 wherein said heat exchanger means includes a matrix of elements having a high thermal conductivity.

31. A system in accordance with claim 30 wherein said elements are sintered metal elements.

32. A system in accordance with claim 31 wherein said sintered metal elements are copper spheres.

33. A system in accordance with claim 28 wherein said load contacting heat exchanger means includes a plurality of fin means connected thereto, said fin means transferring heat from a fluid external to said system into a fluid within said load contacting means.

34. A system in accordance with claims 1, 2, or 10 and further including valve means positioned between said output channel means and said fluid compression means.

35. A system in accordance with claim 34, wherein said valve means, said first means, and said second means are spool valve means.

36. A system in accordance with claims 1, 2, or 10 and further including load contacting means positioned at one of said successive operating stages other than the final stage thereof.

37. A system in accordance with claims 1, 2, or 10 wherein the final one of said successive operating stages includes a cylindrical piston means and first and second concentric tubular means, the diametral clearance between said piston means and said first concentric tubular means of said final operating stage is between 0.0005 inches and 0.003 inches.

38. A system in accordance with claims 1 or 2 and further including a housing positioned above the first stage of said plurality of operating stages, said housing being at room temperature and a portion of said input channel means being in heat exchange relationship with said housing.

* * * * *